US010083699B2

(12) United States Patent
Raju et al.

(10) Patent No.: US 10,083,699 B2
(45) Date of Patent: Sep. 25, 2018

(54) METHOD AND APPARATUS FOR PROCESSING AUDIO DATA

(71) Applicant: SAMSUNG ELECTRONICS CO., LTD., Suwon (KR)

(72) Inventors: Sandeep Raju, Bangalore (IN); Raj Narayana Gadde, Bangalore (IN); Do Hyung Kim, Hwaseong (KR); Chang Yong Son, Gunpo (KR); Kang Eun Lee, Hwaseong (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 861 days.

(21) Appl. No.: 13/949,592

(22) Filed: Jul. 24, 2013

(65) Prior Publication Data

US 2014/0032226 A1 Jan. 30, 2014

(30) Foreign Application Priority Data

Jul. 24, 2012 (IN) ..... 3025/CHE/2012
Jul. 24, 2013 (KR) ..... 10-2013-0087618

(51) Int. Cl.
*G10L 19/008* (2013.01)
*G10L 19/02* (2013.01)
*G10L 21/00* (2013.01)

(52) U.S. Cl.
CPC ..... *G10L 19/008* (2013.01); *G10L 19/0212* (2013.01); *G10L 21/00* (2013.01)

(58) Field of Classification Search
CPC ..... G10L 19/173; H03H 17/0427; H03H 17/0433; H03H 17/0438; H03H 17/0444; H03H 17/045; H03H 17/0455
See application file for complete search history.

(56) References Cited

U.S. PATENT DOCUMENTS 5,982,305 A * 11/1999 Taylor ..... H03H 17/0685 341/50
6,275,836 B1 * 8/2001 Lu ..... H03H 17/0288 708/313
6,681,209 B1 * 1/2004 Schmidt ..... H03H 17/0621 704/219
6,873,650 B1 * 3/2005 Banerjea ..... H04L 27/2608 370/465
7,126,505 B2 * 10/2006 Avantaggiati ..... H03H 17/0685 341/58

(Continued)

*Primary Examiner* — Michael N Opsasnick
(74) *Attorney, Agent, or Firm* — Harness, Dickey & Pierce, P.L.C.

(57) ABSTRACT

A method and apparatus for processing audio data are provided. When an encoded audio bitstream sampled at a sampling frequency is received, a resampling ratio for processing the encoded audio bitstream is computed. If the the resampling ratio is within the resampling threshold range, then the encoded audio bitstream is processed in frequency domain and a desired number of audio samples per frame are outputted according to the resampling ratio. The encoded audio bitstream is processed in frequency domain using sample rate converter integrated into a filter bank of an audio decoder. If the resampling ratio is outside the resampling threshold range, then the encoded audio bitstream is processed in time domain and a desired number of audio samples per frame are outputted according to the resampling ratio.

20 Claims, 6 Drawing Sheets

(56) References Cited

U.S. PATENT DOCUMENTS

| | | | | |
|---|---|---|---|---|
| 2003/0093282 | A1* | 5/2003 | Goodwin | G06F 17/147 704/500 |
| 2005/0089148 | A1* | 4/2005 | Stokes, III | H04M 9/082 379/3 |
| 2007/0282600 | A1* | 12/2007 | Ojanpera | G10L 19/167 704/207 |
| 2009/0319065 | A1* | 12/2009 | Risbo | H03H 17/0628 700/94 |
| 2010/0153122 | A1* | 6/2010 | Wang | G10L 19/173 704/501 |
| 2010/0185450 | A1* | 7/2010 | Huang | H03H 17/0621 704/500 |
| 2011/0004479 | A1* | 1/2011 | Ekstrand | G10L 19/022 704/500 |
| 2011/0182433 | A1* | 7/2011 | Takada | G10L 19/008 381/22 |
| 2012/0016680 | A1* | 1/2012 | Thesing | G10L 19/008 704/500 |
| 2012/0123787 | A1* | 5/2012 | Iwai | G10L 19/167 704/500 |

* cited by examiner

METHOD AND APPARATUS FOR PROCESSING AUDIO DATA

CROSS-REFERENCE TO RELATED APPLICATION

This application claims the benefit under 35 USC § 119(a) of Indian Patent Application No. 3025/CHE/2012 filed on Jul. 24, 2012 and Indian Patent Application No. 3025/CHE/2012, filed on Jul. 24, 2013, in the Intellectual Property India and Korean Patent Application No. 10-2013-0087618, filed on Jul. 24, 2013 in the Korean Intellectual Property Office, the disclosures of which are incorporated herein by reference for all purposes.

BACKGROUND

1. Field

One or more example embodiments of the following description relate to the field of audio processing, and more particularly relates to processing audio data.

2. Description of the Related Art

Audio is captured at various sampling rates depending on required signal quality and available bandwidth for transmission. For example, 48 kHz for professional audio systems (DAT), 44.1 kHz for consumer digital audio (CD) and 32 kHz for digital satellite radio (DSR). This requires audio systems to support playback of audio with different input sampling rates. Also, integration of various audio components in a multimedia system requires change in sampling rate of audio at the interface. For example, most of low power embedded systems have Digital to Analog converters (DAC) that are designed to accept audio data at one particular sampling frequency. Embedded audio playback systems therefore have a dedicated hardware block or software module to perform real time sample rate conversion of audio.

Traditional time domain sample rate converters (SRC) algorithms are computationally intensive and require large memory for high quality output. Frequency domain sample rate converters, when used as stand-alone converters in audio pipeline with compressed input streams; involve the overhead of multiple time—frequency domain inter-conversions. Also, existing SRC implementations in audio playback systems perform resampling in one domain i.e., either time domain or frequency domain, irrespective of resampling ratio. This results in performance degradation of system both in terms of million instructions per second (MIPS) and output quality.

FIG. 1 is a block diagram illustrating a conventional audio processing pipeline 100 in a playback system. In FIG. 1, the audio processing pipeline 100 includes an audio decoder 102 and a sample rate converter 104. The audio decoder 102 decodes encoded audio bitstream 106 and outputs decoded audio data. The sample rate converter (SRC) 104 acts as standalone component which is independent of the audio decoder 102. The decoded audio data 108 is fed as input to the SRC 104. The SRC 104 transforms the decoded audio data from time domain to frequency domain, processes modifies spectrum of the decoded audio data in frequency domain to obtain desired number of audio samples per frame and finally converts the modified spectrum of audio data to time domain to output resampled audio data 110. The cost of resampling increases with above technique because the time and frequency domain inter-conversions are computationally intensive.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

The example embodiments provides a method and system for generating feature descriptor for robust facial expression recognition. In the following detailed description of the embodiments, reference is made to the accompanying drawings that form a part hereof, and in which are shown by way of illustration specific embodiments in which the embodiments may be practiced. These embodiments are described in sufficient detail to enable those skilled in the art to practice the embodiments, and it is to be understood that other embodiments may be utilized and that changes may be made without departing from the scope of the example embodiments. The following detailed description is, therefore, not to be taken in a limiting sense, and the scope of the example embodiments is defined only by the appended claims.

Figure 1:
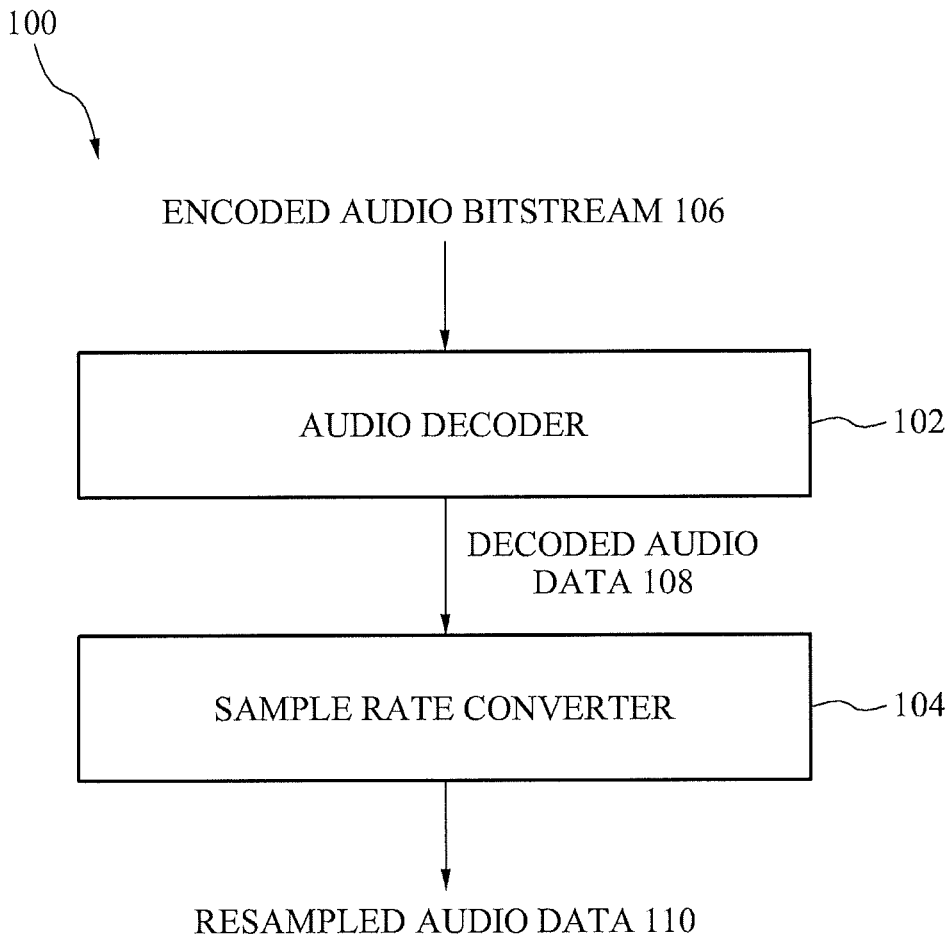
FIG. 1 illustrates a conventional audio processing pipeline in a playback system.
Figure 2:
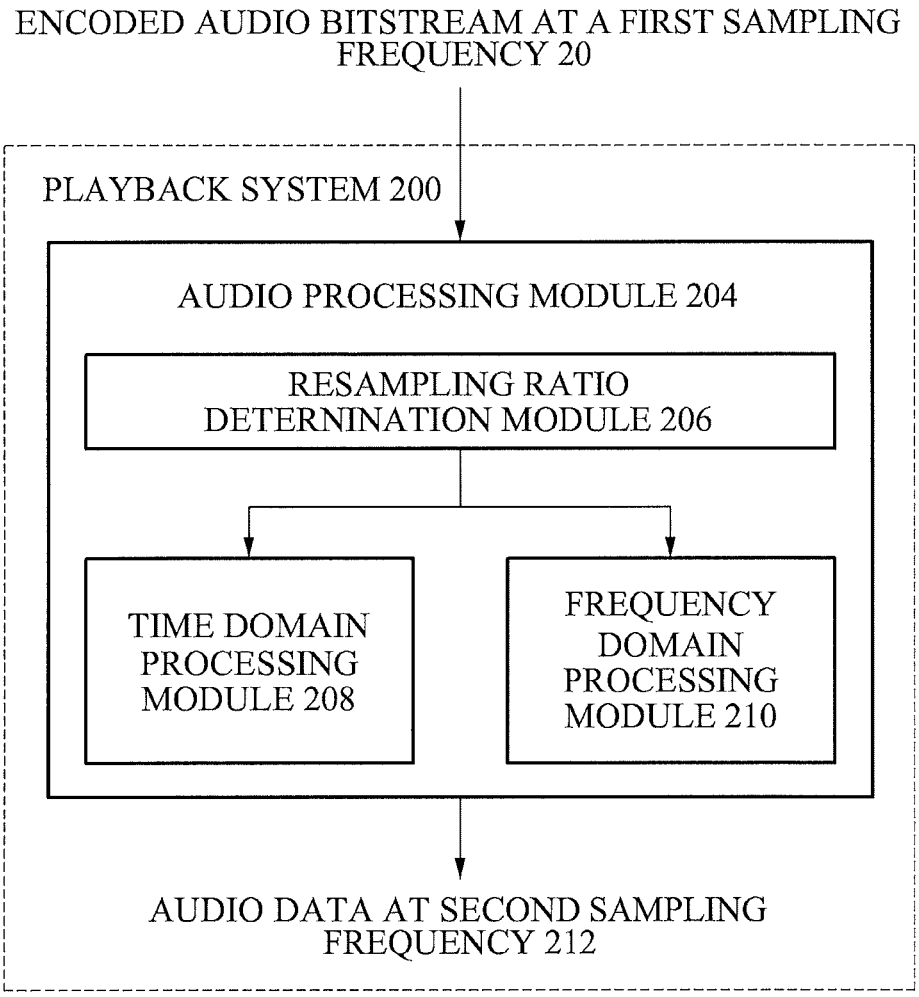
FIG. 2 illustrates a block diagram of an audio processing module in a playback system, according to example embodiments.

FIG. 2 illustrates a block diagram of an audio processing module 204 in a playback system 200, according to example embodiments. In FIG. 2, the audio processing module 204 includes a resampling ratio computation module 206, a time domain processing module 208 and a frequency domain processing module 210.

According to the example embodiments, the resampling ratio computation module 206 computes a resampling ratio associated with an encoded audio bitstream 202. The resampling ratio is equal to ratio of desired sampling frequency (Fs) to sampling frequency (fs) of the encoded audio bitstream 202. If the resampling ratio is outside a resampling threshold range, then the time domain processing module 208 processes the encoded audio bitstream 202 in time domain. If the resampling ratio is within the resampling threshold range, then the frequency domain module 210 processes the encoded audio bit stream 202 in the frequency domain. The steps involved in processing the encoded audio bitstream 202 in time domain and frequency domain is illustrated in FIGS. 4 and 5, respectively.

Figure 3:
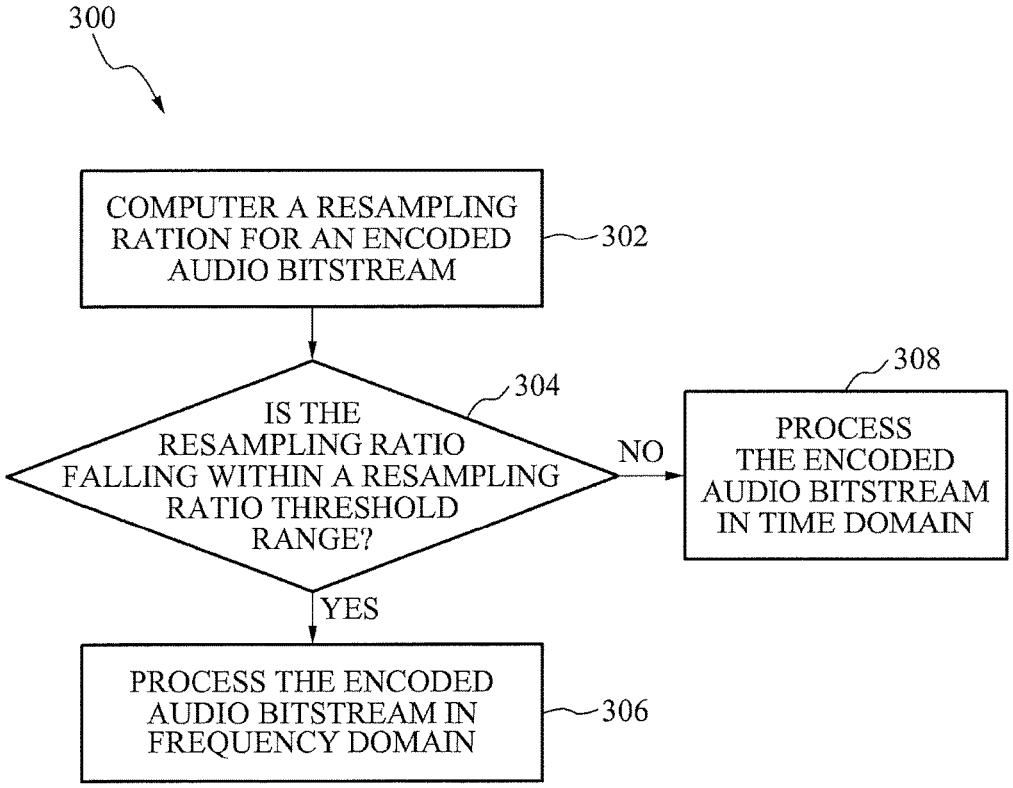
FIG. 3 illustrates an exemplary method of processing encoded audio bitstream based on resampling ratio, according to example embodiments.

FIG. 3 is a process flowchart 300 illustrating an exemplary method of processing encoded audio bitstream based on resampling ratio in the playback system 200, according to example embodiments. When an encoded audio bitstream sampled at a sampling frequency is received, a resampling ratio for processing the encoded audio bitstream is computed, at step 302. The resampling ratio is computed based on the sampling frequency of the encoded audio bitstream (also referred to as first sampling frequency (fs)) and sampling frequency supported by the playback system 200 (also referred to as second sampling frequency (Fs)). In other words, the resampling ratio is equal to (Fs/fs).

At step 304, it is determined whether the resampling ratio is within a resampling threshold range. For example, the resampling threshold range may be equal to 0.2 to 0.5. The range of 0.2 to 0.5 includes standard sample rate conversion between standard sampling frequencies of 48 KHz, 44.1 KHz, and 32 KHz. If it is determined that the resampling ratio is within the resampling threshold range, then at step 306, the encoded audio bitstream is processed in frequency domain and a desired number of audio samples per frame are outputted according to the resampling ratio. If it is determined that the resampling ratio is outside the resampling threshold range, then at step 308, the encoded audio bitstream is processed in time domain and a desired number of audio samples per frame are outputted according to the resampling ratio.

Figure 4:
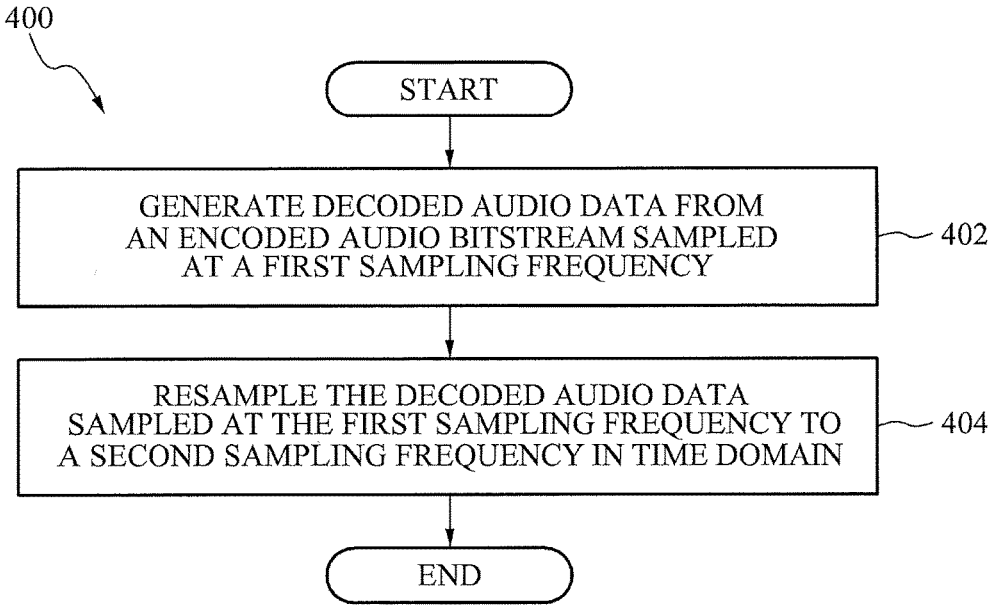
FIG. 4 illustrates an exemplary method of processing the encoded audio bitstream in time domain, according to example embodiments.
Figure 5:
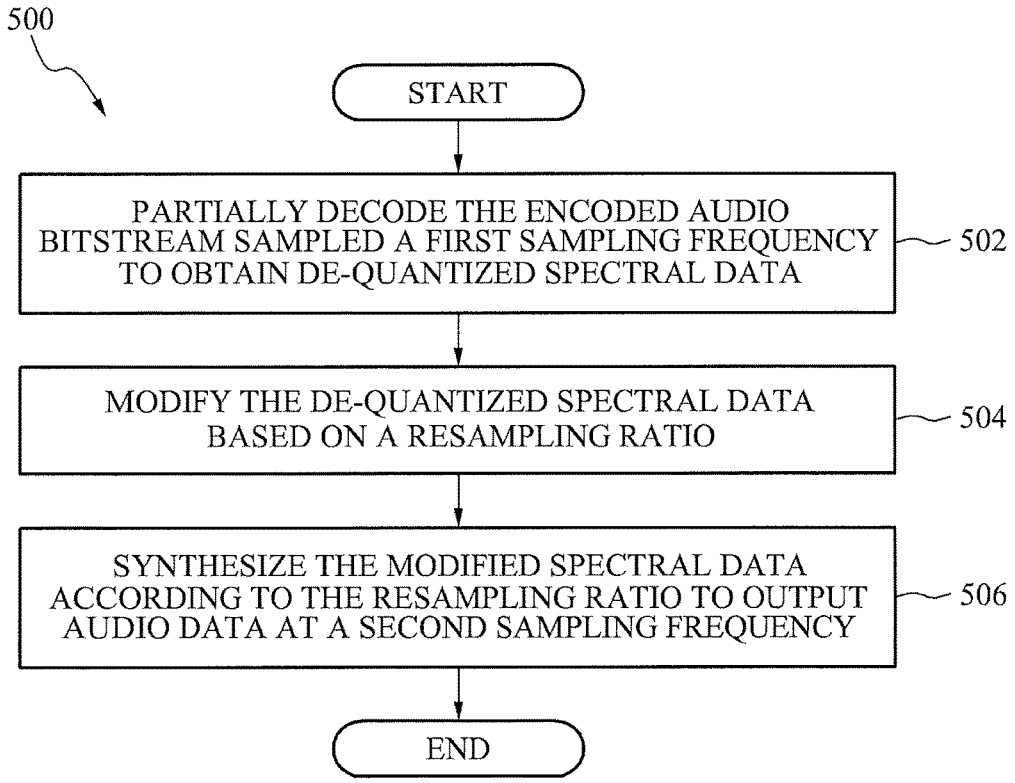
FIG. 5 illustrates an exemplary method of processing the encoded audio bitstream in frequency domain, according to example embodiments.

FIG. 4 is a process flowchart 400 illustrating an exemplary method of processing the encoded audio bitstream in time domain, according to example embodiments. When the resampling ratio is falling outside the resampling threshold range, the time domain processing module 208 processes the encoded audio bitstream in time domain as described in below steps. At step 402, decoded audio data in time domain is generated from the encoded audio bitstream sampled at a first sampling frequency (fs). At step 404, the decoded audio data sampled at the first sampling frequency (fs) is resampled to a second sampling frequency (Fs). The second sampling frequency (Fs) is a sampling frequency required for playing the decoded audio data at the playback system 200. In case the second sampling frequency (Fs) is greater than the first sampling frequency (fs), the decoded audio data is upsampled using an interpolator (e.g., a sin c interpolator). In case the second sampling frequency (Fs) is less than the first sampling frequency (fs), the decoded audio data is downsampled using a combination of interpolator (e.g., sine interpolator) and decimator.

FIG. 5 is a process flowchart 500 illustrating an exemplary method of processing an encoded audio bitstream in frequency domain, according to example embodiments. When the resampling ratio is falling within the resampling threshold range, the frequency domain processing module 210 processes the encoded audio bitstream in frequency domain as described in below steps. At step 502, the encoded audio bitstream sampled at the first sampling frequency (fs) is partially decoded to obtain de-quantized spectral data. In partially decoding the encoded audio bitstream, a noiseless decoding is performed on the encoded audio bitstream followed by inverse quantization of the decoded audio bitstream to obtain the de-quantized spectral data. In some embodiments, the encoded audio bitstream when partially decoded yields a de-quantized modified discrete cosine transform (MDCT) spectrum (i.e., de-quantized spectral data).

At step 504, the de-quantized spectral data is modified based on the resampling ratio to attain desired sampling frequency (i.e., the second sampling frequency (Fs). In case of upsampling, the de-quantized spectral data is modified by padding the de-quantized spectral data with constant values. In downsampling case, the de-quantized spectral data is modified by padding the de-quantized spectral data with constant values such that output audio samples per frame is integer multiple of the desired audio samples per frame.

In one exemplary implementation, the de-quantized MDCT spectrum (Y(k)) is modified for appropriate number of frequency bins (M) so as to match target transform size which in turn matches the desired audio samples per frame. The modified de-quantized MDCT spectrum (Y(k)) is expressed as:

$$Y(k) = \begin{cases} X(k), & 0 \le k < N \\ 0, & N \le k < M, \end{cases}$$

where N is number of frequency bins before modification of the de-quantized MDCT spectrum, M is number of frequency bins after modification of the de-quantized MDCT spectrum, and X(k) is the de-quantized MDCT spectrum.

The number of frequency bins (M) required after modification of the de-quantized MDCT spectrum can be computed using the following equation:

$$M=N*(i*Fs/fs)$$

where i=min {i□Z+:(Fs*i)≥fs}, fs is first sampling frequency of the encoded audio bitstream, and Fs is second sampling frequency supported by the playback system 200.

At step 506, the modified spectral data is synthesized according to the resampling ratio such that decoded audio data with the second sampling frequency (Fs) is outputted. In some embodiments, the modified spectral data is synthesized to output the decoded audio data with the second sampling frequency (Fs) using modified synthesis filterbank of an audio decoder residing in the frequency domain processing module 210. In step 506, the modified spectral data is transformed from the frequency domain to time domain using inverse modified discrete cosine transform (IMDCT). The modified spectral data is transformed from the frequency domain to time domain (x(n)) using the following equation:

$$x(n) = \left(2 \times \frac{i * Fs}{M * fs}\right) \sum_{k=0}^{M-1} X(k) * \cos\left(\left(\frac{\pi}{M}\right) * \left(n + \frac{1}{2} + \frac{M}{2}\right) * \left(k + \frac{1}{2}\right)\right),$$

$$\text{where, } 0 \le n < 2M - 1$$

The IMDCT output (x(n)) is scaled based on the resampling ratio. Then, the scaled IMDCT output is windowed using synthesis window coefficients. Each codec standard defines block switching mechanism, synthesis window shape, size and characteristics for perfect reconstruction of audio data. Based on the codec standard, synthesis window coefficients (w(n)) are redesigned for different size of audio frames (i.e., number of audio samples per frame) such that characteristics is conformant with the codec standard. The re-designed synthesis window coefficients (w(n)) satisfy Princen-Bradley condition for perfect reconstruction as given in below equation:

$$w^2_n + w^2_{n+M} = 1$$

The scaled IMDCT output is windowed using appropriate synthesis window coefficients based on the following equation:

$$x'(n) = x(n) * w(n) 0 \le n < 2M$$

It can be noted that, the audio processing module 204 may derive synthesis window coefficients based on the resampling ratio in run-time. Alternatively, the audio processing module 204 may obtain synthesis window coefficients based on the resampling ratio from a lookup table storing synthesis window coefficients for various resampling ratios.

After windowing operation, audio samples of a current frame of the windowed IMDCT output are overlap added with audio samples of a previous frame of the windowed IMDCT output by a pre-determined value (e.g., fifty percent) to cancel time domain aliasing effect. The audio samples (u(n)) obtained from overlap addition is given in equation below:

$$u(n)=x'(n)+x'_{-1}(M+n)0\leq n<M$$

where, x'(n) is current frame of 2M windowed audio samples, x'−1(n) is previous frame of 2M windowed audio samples.

In case the de-quantized spectral data is downsampled, the windowed and overlapped audio samples are decimated to obtain required number of audio samples per frame (y(n)) according to the resampling ratio. The audio samples per frame (y(n)) obtained after decimating the windowed overlapped audio samples (u(n)) is as given below:

$$y(n) = u(i*n) \quad 0 \leq n < \left(\frac{M}{i}\right)$$

For upsampling case, since i=1, output audio samples per frame (y(n)) is equal to the windowed and overlapped audio samples. That is, the decimated output (y(n)) has required number of audio samples to match desired sampling frequency (Fs).

Figure 6:
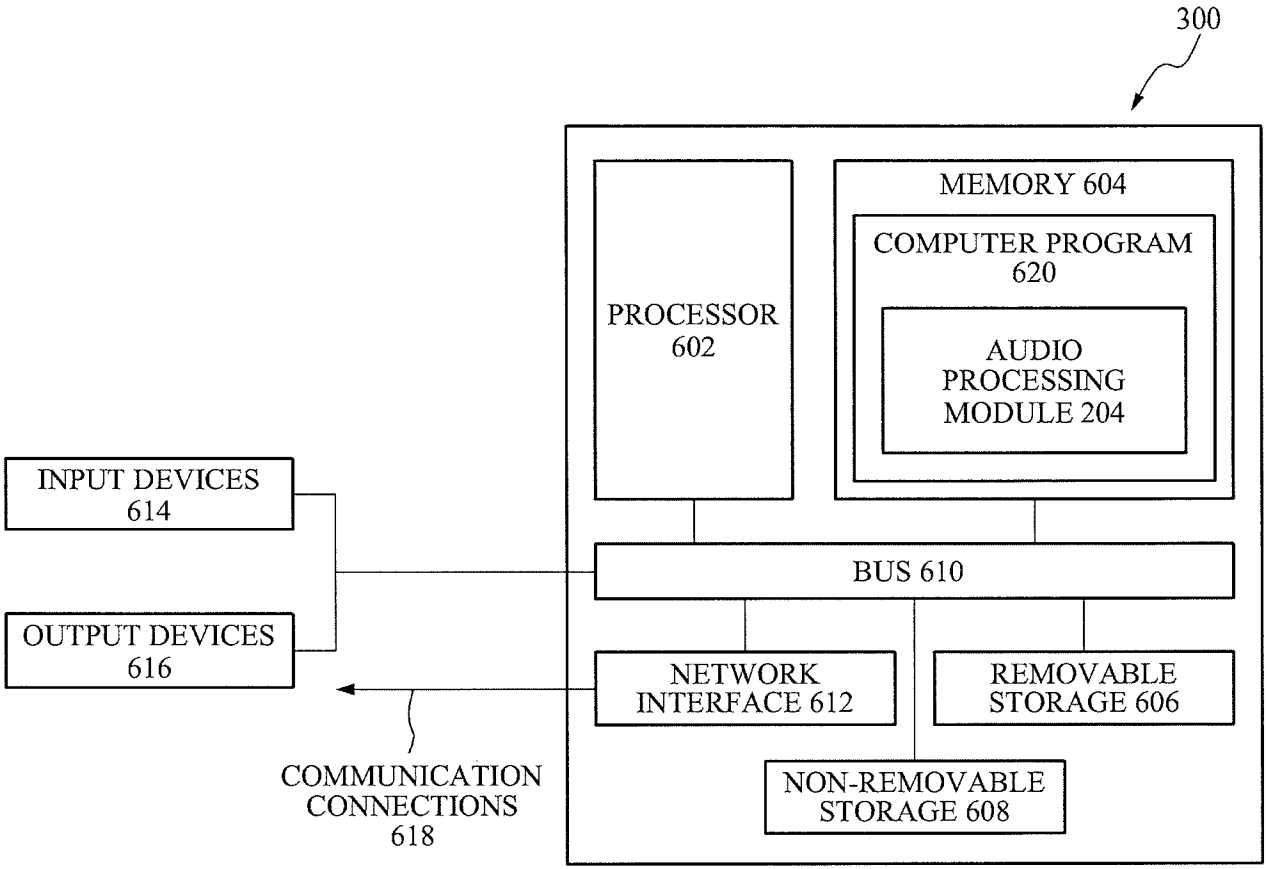
FIG. 6 illustrates an exemplary playback system configured for processing audio data, according to example embodiments.

FIG. 6 shows an example of the playback system 200 for implementing one or more embodiments of the present subject matter. FIG. 6 and the following discussion are intended to provide a brief, general description of the suitable computing environment in which certain embodiments of the inventive concepts contained herein may be implemented.

The playback system 200 may include a processor 602, memory 604, a removable storage 606, and a non-removable storage 608. The playback system 200 additionally includes a bus 610 and a network interface 612. The playback system 200 may include or have access to one or more user input devices 614, one or more output devices 616, and one or more communication connections 618 such as a network interface card or a universal serial bus connection. The one or more user input devices 614 may be joystick, trackpad, keypad, touch sensitive display screen and the like. The one or more output devices 616 may be a display, speakers and the like. The communication connections 618 may include mobile networks such as Wireless Area Network (WAN) and Local Area Network (LAN), and the like.

The memory 604 may include volatile memory and/or non-volatile memory for storing computer program 620. A variety of computer-readable storage media may be stored in and accessed from the memory elements of the playback system 200, the removable storage 606 and the non-removable storage 608. Computer memory elements may include any suitable memory device(s) for storing data and machine-readable instructions, such as read only memory, random access memory, erasable programmable read only memory, electrically erasable programmable read only memory, hard drive, removable media drive for handling compact disks, digital video disks, external hard drives, memory sticks, memory cards and the like.

The processor 602, as used herein, means any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a graphics processor, a digital signal processor, or any other type of processing circuit. The processor 602 may also include embedded controllers, such as generic or programmable logic devices or arrays, application specific integrated circuits, single-chip computers, smart cards, and the like.

Embodiments of the present subject matter may be implemented in conjunction with program modules, including functions, procedures, data structures, and application programs, for performing tasks, or defining abstract data types or low-level hardware contexts. The audio processing module 204 may be stored in the form of machine-readable instructions on any of the above-mentioned storage media and is executed by the processor 602 of the playback system 200. For example, a computer program 620 includes the machine-readable instructions configured for processing audio data, according to the various embodiments of the present subject matter.

The present embodiments have been described with reference to specific example embodiments; it will be evident that various modifications and changes may be made to these embodiments without departing from the broader spirit and scope of the various embodiments. Furthermore, the various devices, modules, and the like described herein may be enabled and operated using hardware circuitry, for example, complementary metal oxide semiconductor based logic circuitry, firmware, software and/or any combination of hardware, firmware, and/or software embodied in a machine readable medium. For example, the various electrical structure and methods may be embodied using transistors, logic gates, and electrical circuits, such as application specific integrated circuit.

What is claimed is:

1. A method of processing audio data in frequency domain, comprising:

determining, by at least one processor, if a resampling ratio of an encoded audio bitstream sampled at a first sampling frequency is within a resampling threshold range;

processing, by the at least one processor, the encoded audio bitstream in frequency domain, if the resampling ratio is within the resampling threshold range to reproduce audio data sampled at a second sampling frequency, the processing the encoded audio bitstream in the frequency domain including, partially decoding the encoded audio bitstream to obtain de-quantized spectral data, modifying the de-quantized spectral data based on the resampling ratio to obtain modified spectral data, and synthesizing the modified spectral data according to the resampling ratio to reproduce audio data sampled at the second sampling frequency, the synthesizing the modified spectral data including, converting the modified spectral data from frequency domain to time domain using IMDCT to obtain IMDCT output data, and performing scaling of the IMDCT output data based on the resampling ratio to obtain scaled IMDCT output data; and outputting an output signal including the reproduced audio data sampled at the second sampling frequency.

2. The method of claim 1, wherein the modifying the de-quantized spectral data based on the resampling ratio comprises:

padding the de-quantized spectral data with constant values based on the resampling ratio, if the second sampling frequency is greater than the first sampling frequency.

3. The method of claim 1, wherein the modifying the de-quantized spectral data based on the resampling ratio comprises:

padding the de-quantized spectral data with constant values based on the resampling ratio, if the second sampling frequency is less than the first sampling frequency such that audio samples per frame obtained after padding the de-quantized spectral data is integer multiple of desired audio samples per frame.

4. The method of claim 1, wherein the synthesizing the modified spectral data according to the resampling ratio further comprises:

windowing the scaled IMDCT output data using synthesis window coefficients corresponding to the resampling ratio to obtain windowed IMDCT output data; and adding a pre-determined amount of overlap between audio samples of current frame of the windowed IMDCT output data and audio samples of previous frame of the windowed IMDCT output data.

5. The method of claim 4, wherein the adding the pre-determined amount of overlap between the audio samples of the current frame of the windowed IMDCT output data and the audio samples of the previous frame of the windowed IMDCT output data further comprises:

decimating overlapped audio samples to obtain required number of audio samples per frame according to the resampling ratio, if the second sampling frequency is less than the first sampling frequency.

6. An apparatus comprising:

a processor; and a memory containing computer readable code that, when executed by the processor, causes the processor to, determine, if a resampling ratio of an encoded audio bitstream sampled at a first sampling frequency is within a resampling threshold range, partially decode the encoded audio bitstream sampled at the first sampling frequency to obtain de-quantized spectral data, if the resampling ratio is within the resampling threshold range, modify the de-quantized spectral data based on the resampling ratio to obtain modified spectral data, and synthesize the modified spectral data according to the resampling ratio to reproduce audio data sampled at a second sampling frequency by, converting the modified spectral data from frequency domain to time domain using IMDCT to obtain IMDCT output data, and performing scaling of the IMDCT output data based on the resampling ratio to obtain scaled IMDCT output data, and outputting an output signal including the reproduced audio data sampled at the second sampling frequency.

7. A method of processing audio data, comprising:

computing, by at least one processor, a resampling ratio of an encoded audio bitstream sampled at a first sampling frequency;

determining, by the at least one processor, if the resampling ratio of the encoded audio bitstream is within a resampling threshold range;

processing, by the at least one processor, the encoded audio bitstream in time domain to reproduce audio data sampled at a second sampling frequency, if the resampling ratio is outside the resampling threshold range;

processing, by the at least one processor, the encoded audio bitstream in frequency domain by using inverse modified discrete cosine transform (IMDCT) and scaling based on the resampling ratio, if the resampling ratio is within the resampling threshold range to reproduce audio data sampled at the second sampling frequency; and outputting an output signal including the processed audio bitstream.

8. The method of claim 7, wherein the processing the encoded audio bitstream in the frequency domain comprises:

partially decoding the encoded audio bitstream to obtain de-quantized spectral data;

modifying the de-quantized spectral data based on the resampling ratio to obtain modified spectral data; and synthesizing the modified spectral data according to the resampling ratio to reproduce audio data sampled at the second sampling frequency, by at least converting the modified spectral data from frequency domain to time domain using IMDCT to obtain IMDCT output data, and performing scaling of the IMDCT output data based on the resampling ratio to obtain scaled IMDCT output data.

9. The method of claim 8, wherein the modifying the de-quantized spectral data based on the resampling ratio comprises:

padding the de-quantized spectral data with constant values based on the resampling ratio, if the second sampling frequency is greater than the first sampling frequency.

10. The method of claim 8, wherein the modifying the de-quantized spectral data based on the resampling ratio comprises:

padding the de-quantized spectral data with constant values based on the resampling ratio, if the second sampling frequency is less than the first sampling frequency such that audio samples per frame obtained after padding the de-quantized spectral data is integer multiple of desired audio samples per frame.

11. The method of claim 8, wherein the synthesizing the modified spectral data according to the resampling ratio further comprises:

windowing the scaled IMDCT output data using synthesis window coefficients corresponding to the resampling ratio to obtain windowed IMDCT output data; and adding a pre-determined amount of overlap between audio samples of current frame of the windowed IMDCT output data and audio samples of previous frame of the windowed IMDCT output data.

12. The method of claim 11, wherein the adding the pre-determined amount of overlap between the audio samples of the current frame of the windowed IMDCT output data and the audio samples of the previous frame of the windowed IMDCT output data further comprises:

decimating overlapped audio samples to obtain required number of audio samples per frame according to the resampling ratio, if the second sampling frequency is less than the first sampling frequency.

13. An apparatus comprising:

a processor; and a memory containing computer readable code that, when executed by the processor, causes the processor to, compute a resampling ratio of an encoded audio bitstream sampled at a first sampling frequency, determine, if the resampling ratio of the encoded audio bitstream is within a resampling threshold range, process the encoded audio bitstream in time domain to reproduce audio data sampled at a second sampling frequency, if the resampling ratio is outside the resampling threshold range, process the encoded audio bitstream in frequency domain by using inverse modified discrete cosine transform (IMDCT) and scaling based on resampling ratio, if the resampling ratio is within the resampling threshold range to reproduce audio data sampled at the second sampling frequency, and output an output signal including the processed audio bitstream.

14. The apparatus of claim 13, wherein the processor is configured to process the encoded audio bitstream in the frequency domain by, partially decoding the encoded audio bitstream to obtain de-quantized spectral data, modifying the de-quantized spectral data based on the resampling ratio to obtain modified spectral data, and synthesizing the modified spectral data according to the resampling ratio to reproduce audio data sampled at the second sampling frequency, by at least converting the modified spectral data from frequency domain to time domain using IMDCT to obtain IMDCT output data, and performing scaling of the IMDCT output data based on the resampling ratio to obtain scaled IMDCT output data.

15. The apparatus of claim 14, wherein the processor is configured to modify the de-quantized spectral data based on the resampling ratio by padding the de-quantized spectral data with constant values based on the resampling ratio, if the second sampling frequency is greater than the first sampling frequency.

16. The apparatus of claim 14, wherein the processor is configured to modify the de-quantized spectral data based on the resampling ratio by padding the de-quantized spectral data with constant values based on the resampling ratio, if the second sampling frequency is less than the first sampling frequency such that audio samples per frame obtained after padding the de-quantized spectral data is integer multiple of desired audio samples per frame.

17. The apparatus of claim 14, wherein the processor is configured to synthesize the modified spectral data according to the resampling ratio by, windowing the scaled IMDCT output data using synthesis window coefficients corresponding to the resampling ratio to obtain windowed IMDCT output data, and adding a pre-determined amount of overlap between audio samples of current frame of the windowed IMDCT output data and audio samples of previous frame of the windowed IMDCT output data.

18. The apparatus of claim 17, wherein the processor is configured to decimate overlapped audio samples to obtain required number of audio samples per frame according to the resampling ratio, if the second sampling frequency is less than the first sampling frequency.

19. A non-transitory computer-readable storage medium having instructions stored thereon, which when executed by a processor, cause the processor to compute a resampling ratio of an encoded audio bitstream sampled at a first sampling frequency;

determine, if the resampling ratio of the encoded audio bitstream is within a resampling threshold range;

process the encoded audio bitstream in time domain to reproduce audio data sampled at a second sampling frequency, if the resampling ratio is outside the resampling threshold range;

process the encoded audio bitstream in frequency domain, if the resampling ratio is within the resampling threshold range to reproduce audio data sampled at the second sampling frequency, by using inverse modified discrete cosine transform (IMDCT) and scaling based on the resampling ratio; and output an output signal including the processed audio bitstream.

20. The non-transitory computer-readable storage medium of claim 19, wherein the instructions cause the processor to process the encoded audio bitstream in the frequency domain by, partially decoding the encoded audio bitstream to obtain de-quantized spectral data, modifying the de-quantized spectral data based on the resampling ratio to obtain modified spectral data, and synthesizing the modified spectral data according to the resampling ratio to reproduce audio data sampled at the second sampling frequency, by at least converting the modified spectral data from frequency domain to time domain using IMDCT to obtain IMDCT output data, and performing scaling of the IMDCT output data based on the resampling ratio to obtain scaled IMDCT output data.

* * * * *